US010054969B2

(12) United States Patent
Subramanian et al.

(10) Patent No.: US 10,054,969 B2
(45) Date of Patent: Aug. 21, 2018

(54) MONOLITHIC REFERENCE ARCHITECTURE WITH BURST MODE SUPPORT

(71) Applicant: TEXAS INSTRUMENTS INCORPORATED, Dallas, TX (US)

(72) Inventors: Anand Subramanian, Bangalore (IN); Anand Kannan, Bangalore (IN); Sunil Rafeeque, Bangalore (IN); Venakatesh Guduri, Bangalore (IN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/259,368

(22) Filed: Sep. 8, 2016

(65) Prior Publication Data

US 2017/0068265 A1 Mar. 9, 2017

(30) Foreign Application Priority Data

Sep. 8, 2015 (IN) ..... 4756/CHE/2015

(51) Int. Cl.

| | |
|---|---|
| ***G05F 1/10*** | (2006.01) |
| ***G05F 3/02*** | (2006.01) |
| ***G05F 1/565*** | (2006.01) |
| ***G05F 1/625*** | (2006.01) |
| ***G05F 3/16*** | (2006.01) |
| ***G05F 1/575*** | (2006.01) |

(52) U.S. Cl.

CPC ..... *G05F 1/575* (2013.01)

(58) Field of Classification Search

CPC . G05F 1/575; G05F 1/565; G05F 1/10; G06F 1/26

USPC ..... 327/530–546; 323/312–317

See application file for complete search history.

(56) References Cited

U.S. PATENT DOCUMENTS

| | | | | |
|---|---|---|---|---|
| 6,246,221 | B1 * | 6/2001 | Xi | G05F 1/575 323/280 |
| 7,205,828 | B2 * | 4/2007 | Sridharan | G05F 1/575 327/540 |
| 8,022,681 | B2 * | 9/2011 | Gurcan | G05F 1/565 323/283 |
| 9,535,439 | B2 * | 1/2017 | Jain | G05F 1/575 |
| 9,541,973 | B2 * | 1/2017 | Yang | G06F 1/26 |

(Continued)

OTHER PUBLICATIONS

Linear Technology Corporation, "LTC2338-18"; © Linear Technology Corporation 2016, 26 p. [Online] www.linear.com/LTC2338-18.

(Continued)

*Primary Examiner* — Brandon S Cole

(74) *Attorney, Agent, or Firm* — John R. Pessetto; Charles A. Brill; Frank D. Cimino

(57) ABSTRACT

A reference circuit may include a bandgap reference stage, a filter stage, and a buffer stage. The reference stage may be configured to generate a reference voltage or current. The filter stage may be coupled to the reference stage and may be configured to receive the reference voltage or current, filter noise from the reference voltage or current, receive a buffer output voltage or current, and filter noise from the buffer output voltage or current. The buffer stage may be coupled to the filter stage and may be configured to isolate the reference stage and the filter stage from a loading effect of a load circuit and generate a reference signal based on the reference voltage or current to drive the load circuit.

23 Claims, 1 Drawing Sheet

(56) References Cited

U.S. PATENT DOCUMENTS

| | | | | |
|---|---|---|---|---|
| 9,552,006 | B1 * | 1/2017 | Gorecki | G05F 1/575 |
| 2006/0033555 | A1 * | 2/2006 | Sridharan | G05F 1/575<br>327/540 |
| 2008/0174289 | A1 * | 7/2008 | Gurcan | G05F 1/575<br>323/280 |
| 2010/0072964 | A1 * | 3/2010 | Qiu | H02M 3/156<br>323/282 |
| 2011/0163799 | A1 * | 7/2011 | Kuang | H01C 17/22<br>327/539 |
| 2013/0033305 | A1 * | 2/2013 | Fukazawa | G05F 1/567<br>327/539 |
| 2016/0334818 | A1 * | 11/2016 | Singh | G05F 1/56 |
| 2016/0334819 | A1 * | 11/2016 | Pelicia | G05F 1/575 |

OTHER PUBLICATIONS

Kumar, V., "18-Bit, 1MSPS Data Acquisition Block (DAQ) Optimized for Lowest Distortion and Noise"; SLAU515A Jun. 2013, Revised Oct. 2015, 36 p.

* cited by examiner

MONOLITHIC REFERENCE ARCHITECTURE WITH BURST MODE SUPPORT

CROSS-REFERENCE TO RELATED APPLICATIONS

The present application claims priority to Indian Provisional Patent Application No. 4756/CHE/2015, filed Sep. 8, 2015, titled "Low Noise, High Bandwidth, Monolithic Reference Architecture For High Performance ADCs With Burst Mode And Varying DC Current Support," which is incorporated herein by reference in its entirety.

BACKGROUND

Reference circuits are used in a variety of electronic systems to provide a known and consistent reference signal to other circuits or components within, or external to, the electronic systems. As used herein, a reference signal may be an electrical signal that may represented as a voltage magnitude or a current magnitude. A circuit to which a reference signal may be provided may depend on the reference signal, for example, to determine a degree of accuracy of an output of the circuit.

SUMMARY

In some embodiments, a reference circuit may include a bandgap reference stage, a filter stage, and a buffer stage. The reference stage may be configured to generate a reference voltage or current. The filter stage may be coupled to the reference stage and configured to receive the reference voltage or current, filter noise from the reference voltage or current, receive a buffer output voltage or current, and filter noise from the buffer output voltage or current. The buffer stage may couple to the filter stage and be configured to isolate the reference stage and the filter stage from a loading effect of a load circuit, and generate a reference signal based on the reference voltage or current to drive the load circuit.

In another implementation, a reference circuit includes a circuit configured to generate a temperature independent voltage or current, an adjustment circuit, a filter, and a buffer. The adjustment circuit may be configured to adjust the temperature independent voltage or current. The filter may be configured to filter noise from the reference circuit. The buffer may be coupled to the filter and a load and configured to drive the load to a voltage magnitude or current magnitude indicative of the temperature independent voltage or current.

In a further implementation, a reference circuit includes a bandgap reference, a resistor ladder, an operational transconductance amplifier, and a buffer. The bandgap reference may be configured to generate a bandgap reference voltage or current. The resistor ladder may be coupled to the bandgap reference and configured to trim the bandgap reference voltage or current. The operational transconductance amplifier may be coupled to the resistor ladder and configured to filter out at least a portion of electrical noise in the reference circuit. The buffer may be coupled to the operational transconductance amplifier and configured to isolate and drive a load coupled to the reference circuit.

BRIEF DESCRIPTION OF THE DRAWINGS

For a detailed description of various examples, reference will now be made to the accompanying drawings in which.

NOTATION AND NOMENCLATURE

Figure 1:
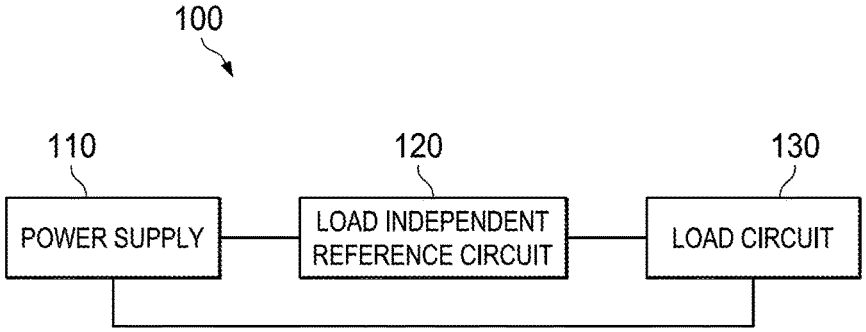
FIG. 1 shows a block diagram of an electronic system in accordance with various embodiments.

Certain terms are used throughout the following description and claims to refer to particular system components. As one skilled in the art will appreciate, companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ."

The term "couple" or "couples" is intended to mean either an indirect or direct electrical connection. Thus, if a first device couples to a second device, that connection may be through a direct electrical connection, or through an indirect electrical connection via other devices and connections.

The recitation "based on" is intended to mean "based at least in part on." Therefore, if X is based on Y, X may be based on Y and any number of other factors.

DETAILED DESCRIPTION

The following discussion is directed to various embodiments of the invention. Although one or more of these embodiments may be preferred, the embodiments disclosed herein should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

A reference circuit may be coupled to an electrical component that makes determinations or calculations based, at least in part, on a reference signal provided by the reference circuit. For example, a reference circuit may be coupled to an analog-to-digital converter (ADC) to provide the ADC with a reference signal for use during conversions performed by the ADC. Although the following discussion may refer to an ADC in an exemplary manner for the sake of understanding and clarity of description, as one skilled in the art will appreciate, this disclosure is not limited thereto, but instead is applicable generally to any application in which a reference signal may be utilized.

A degree of accuracy of an output or result of the ADC may be related to the reference signal such that fluctuation or variation in the reference signal from its known or optimal magnitude during operation of the ADC may cause errors in the ADC output. Such errors may result in an incorrect and/or inaccurate output value of the ADC. When an ADC is activated, for example, to perform a conversion of an analog signal to a digital value, from a powered off state or an extended idle state of no conversions, the ADC may impose a loading effect on one or more circuits coupled to the ADC. This loading effect may be resistive, capacitive, and/or inductive in nature, and may cause a change in a voltage magnitude and/or a current magnitude provided to the ADC. The change may be momentary such that the circuits coupled to the ADC recover after a period of time to compensate for the loading effect and correct the change in the voltage magnitude and/or current magnitude provided to the ADC. In the case of a reference circuit, the loading caused by the ADC may change a magnitude of the reference signal for a period of time and may cause a corresponding error in an output value of the ADC for at least a portion of the period of time. For example, loading of the reference circuit by the ADC may cause an error in the output value of the ADC when a burst mode conversion (e.g., a conversion in which the ADC receives a small number of analog signals to convert in a period closely following activation of the ADC such that the analog signals are converted during the period of time during which the reference signal is reduced) takes place.

Additionally, electrical noise within the electronic system may cause potentially undesirable variations in the reference signal, thereby resulting in an incorrect and/or inaccurate ADC output value. The electrical noise may be caused, for example, through use of active components within the electronic system. Active components within the electrical system may generally be understood as components which may be capable of providing power amplification to the electronic system to process, manipulate, and/or otherwise interact with a signal in the electronic system. Examples of active components may include powered components such as amplifiers, current sources, transistors, and other like components that include a connection to the power supply. In contrast, passive components within the electronic system may generally be understood as components that may not provide power amplification to the electronic system. Examples of passive components may be resistors, capacitors, inductors, connectors, and other like components.

An active component such as a current source may be used to trim and/or adjust an electrical characteristic of the electronic system. However, the active component may add additional undesirable electrical noise, such as low-frequency electrical noise, to the electrical system. At least some of the low-frequency electrical noise may be referred to as flicker noise. Flicker noise may be a low-frequency electrical noise that has an inverse relationship to a size (e.g., an area or footprint) of an electrical component. Therefore, increasing a size of an electrical component causing the flicker noise may reduce flicker noise. However, such an increase in size may result in a potentially undesirable increase in manufacturing cost and power consumed by the electronic system.

Electrical noise in the electronic system may also be characterized as integrated noise (e.g., a total noise across all frequencies of an operational bandwidth of the electronic system). Therefore, as bandwidth in the electronic system increases, so too does electrical noise in the electronic system. However, high bandwidth may be desirable to support burst mode operations of load circuits with a minimal change to the reference signal. At the same time, a low magnitude of noise in the reference signal may also be desirable and in conflict with conventional reference circuit implementations for providing high bandwidth. Consequently, techniques for providing a reference circuit having a high bandwidth and burst mode support with minimal noise and power consumption may be desirable.

The reference circuit disclosed herein may support burst mode operation of the load circuit while reducing a magnitude of noise present in an output of the reference circuit, support a high bandwidth, and consume a reduced amount of power relative to conventional reference circuit implementations. Embodiments of the reference circuit may employ a buffered bandgap reference, filtered by a filter that may include an operational transconductance amplifier and a capacitor. Embodiments of the reference circuit may have a load independent bandwidth that supports burst mode operation while reducing power consumption and electrical noise such as low-frequency noise (e.g., to a magnitude less than 3 micro volts (pV) peak-to-peak (p-p) in a frequency range from 0.1 hertz (Hz) to 10 Hz) and integrated noise relative to conventional reference circuits while providing equivalent or improved performance.

FIG. 1 shows a block diagram of an electronic system 100 in accordance with various embodiments. The electronic system 100 includes a power supply 110, a load independent reference circuit 120, and a load circuit 130. The power supply 110 may be any suitable power supply included within, or coupled to, the electronic system 100. The power supply 110 may include, for example, any one or more electrical components (e.g., a transformer, an integrated circuit, or other suitable components such as power regulation or conditioning electrical components) configured to output one or more direct current (DC) or alternating current (AC) voltages for use by the load independent reference circuit 120 and/or the load circuit 130 for powering at least some components of the load independent reference circuit 120 and the load circuit 130.

The load circuit 130 may be a circuit configured to utilize a reference signal in performing one or more operations on signals existing within the electronic system 100 and received from, or transmitted to, other circuits (not shown) of the electronic system 100. The load circuit 130 may include, for example, the ADC discussed above, a digital-to-analog converter (DAC), another power supply, other measurement circuitry, control circuitry or other types of circuitry that operates from a consistent, low noise reference signal for operations of the load circuit 130.

The load independent reference circuit 120 may be coupled to the load circuit 130 and may be configured to provide the load circuit 130 with a reference signal. Optionally, the load independent reference circuit 120 may be coupled to a plurality of load circuits 130, and may provide the same or different reference signals to each load circuit 130. The load independent reference circuit 120 may be configured to generate a bandgap reference voltage (e.g., a temperature independent voltage magnitude) and provide the bandgap reference voltage to the load circuit 130 via a buffer that isolates the bandgap reference voltage from the load circuit 130. Alternatively, the load independent reference circuit 120 may be configured to generate a bandgap reference current (e.g., a temperature independent current magnitude) and provide the bandgap reference current to the load circuit 130 via a buffer that isolates the bandgap reference current from the load circuit 130. Although the following discussion may take place with regard to a bandgap reference voltage, it is understood that such discussion is equally applicable to a bandgap reference current. Such a buffer may prevent the load circuit 130 from imposing a loading effect on the bandgap reference that changes a magnitude of the bandgap reference voltage. The buffer may process an output of the load independent reference circuit 120 to make the load independent reference circuit 120 independent of the load (e.g., such that the load does not effect a value of a bandwidth or a magnitude of noise of the load independent reference circuit 120). The load independent reference circuit 120 may also include a filter configured to filter out at least some electrical noise from the electronic system 100. For example, the filter may attenuate at least some of the low-frequency (e.g., flicker) noise, the integrated noise, or both from one or more signals (e.g., an output signal, or a non-output signal) of the electronic system 100.

Figure 2:
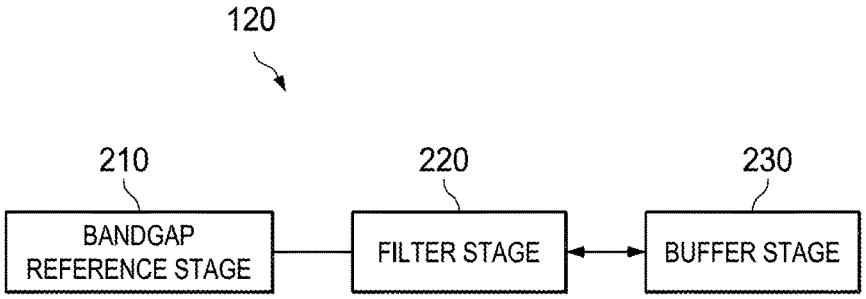
FIG. 2 shows a block diagram of a reference circuit in accordance with various embodiments.

FIG. 2 shows a block diagram of the load independent reference circuit 120 in accordance with various embodiments. The load independent reference circuit 120 may include a bandgap reference stage 210, a filter stage 220, and a buffer stage 230. The bandgap reference stage 210 may be configured to generate a bandgap reference voltage or current as described above for use by the load circuit 130. Alternatively, the load independent reference circuit 120 may include a reference stage other than the bandgap reference stage 210 that may be configured to generate a suitable reference voltage or current for use by the load circuit 130. As such, discussions directed to the bandgap reference stage 210 may be equally applicable to any reference stage included in the load independent reference circuit 120 and configured to generate a suitable reference voltage or current for use by the load circuit 130. The filter stage 220 may be coupled to the bandgap reference stage 210 and may be configured to receive the bandgap reference voltage from the bandgap reference stage 210. The filter stage 220 may also be coupled to the buffer stage 230 to provide the buffer stage 230 with a filtered bandgap reference voltage that has a reduced magnitude of low-frequency noise and integrated noise relative to conventional reference circuit implementations. To reduce a magnitude of high-frequency noise, for example, as created by the bandgap reference stage 210 (such as during generation of the bandgap reference voltage), the filter stage 220 may operate as a low-pass filter that allows low-frequency noise to pass through the filter stage 220 to the buffer stage 230 while attenuating high-frequency noise to a reduced magnitude that may be considered acceptable for a reference signal. The filter stage 220 also may receive an output from the buffer stage 230 via a feedback loop (e.g., a unity gain feedback loop or a scaling feedback loop) to filter the low-frequency noise added to the output of the buffer stage 230 via one or more components of the buffer stage 230 (e.g., as a result of design decisions prioritizing bandwidth, high-frequency performance, power consumption, etc.).

For example, as described above, low-frequency or flicker noise may have an inverse relationship with an area of an electrical component within the electronic system 100. Thus, when the buffer 230 is designed for a reduced power consumption, increased bandwidth, or improved high-frequency performance relative to conventional reference circuit implementations, the buffer 230 may contribute additional low-frequency noise to the reference signal. However, via the feedback loop from the buffer stage 230 to the filter stage 220, the filter stage 220 may filter the low-frequency noise from the resulting reference signal. For example, the filter stage 220 may include one or more differential components that subtract a signal of one input of the differential component from a signal of a second input of the differential component to form an output of the differential component. Such a differential operation my enable the filter stage 220 to compensate for the low-frequency noise added to the reference signal by the buffer stage 230. In this manner, filter stage 220 may also operate as a high-pass filter that attenuates low-frequency noise of the buffer stage 230 to a reduced magnitude that may be considered acceptable for a reference signal, while passing a minimal and/or acceptable magnitude of high-frequency noise as a result of the low-pass functionality of the filter stage 220 to its reference input.

Figure 3:
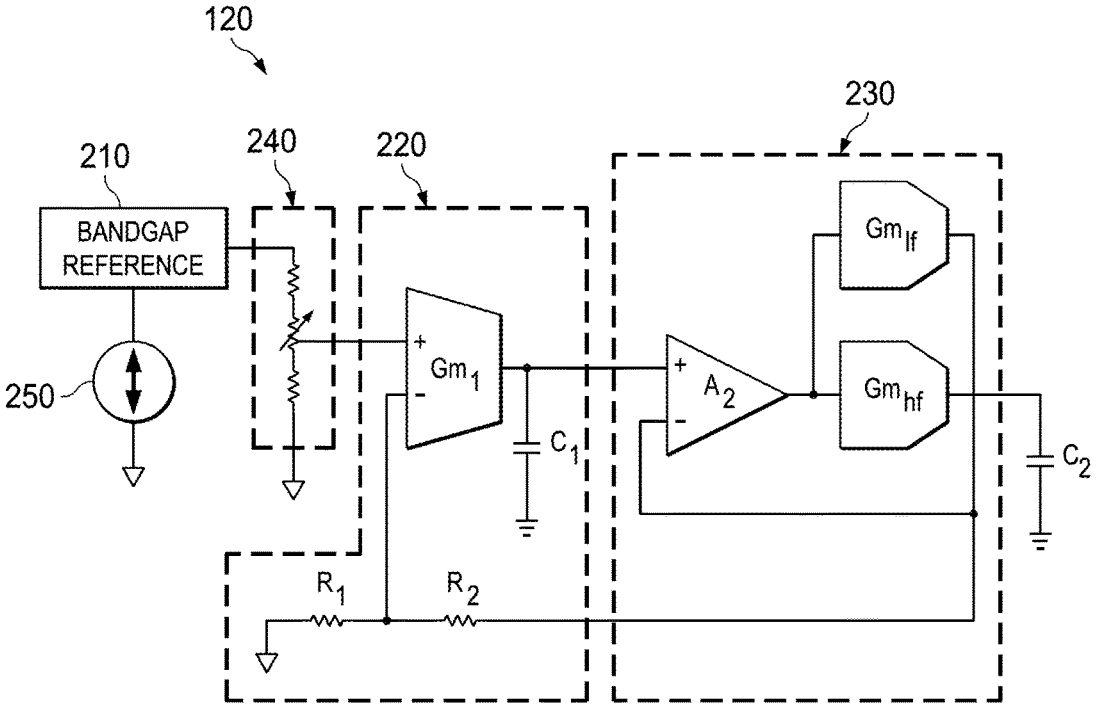
FIG. 3 shows a schematic diagram of a reference circuit in accordance with various embodiments.

FIG. 3 shows a schematic diagram of the load independent reference circuit 120 in accordance with various embodiments. As discussed above, the load independent reference circuit 120 may include the bandgap reference stage 210, the filter stage 220, and the buffer stage 230. The load independent reference circuit 120 may further include a resistor ladder 240 coupled between the bandgap reference stage 210 and the filter stage 220. As discussed above, the bandgap reference stage 210 may generate a bandgap reference voltage (e.g., 1.2 volts, 2.4 volts, or any other suitable voltage magnitude) for use by the load circuit 130. It should be noted that the bandgap reference voltage generated by the bandgap reference stage 210 may be the reference signal, or may be a signal of another magnitude other than the reference signal that may be changed to the reference signal through subsequent processing by one or more components of the load independent reference circuit 120. The bandgap reference voltage generated by the bandgap reference stage 210 may be trimmed, or adjusted, to increase a magnitude of accuracy of the bandgap reference voltage generated by the bandgap reference stage 210, and thereby the reference signal provided by the load independent reference circuit 120. For example, if environmental factors, load characteristics, and/or processing by filter stage 220 or the buffer stage 230 modifies the bandgap reference voltage generated by the bandgap reference stage 210 for use as the reference signal from an optimal or desired magnitude, the bandgap reference voltage generated by the bandgap reference stage 210 may be adjusted to compensate for the modifications. The adjustments may be performed, for example, by providing initial, or coarse, accuracy adjustment to the voltage generated by the bandgap reference stage 210 via the resistor ladder 240 to modify the bandgap reference voltage generated by the bandgap reference stage 210. The adjustments may also be performed, for example, by coupling a current source 250 to the bandgap reference stage 210 to provide fine accuracy adjustment (e.g., accuracy adjustment to compensate for drift or variation in the bandgap reference voltage generated by the bandgap reference stage 210 based on temperature) to the bandgap reference voltage generated by the bandgap reference stage 210. Utilizing the resistor ladder 240 to perform initial accuracy adjustment, which in many embodiments may be a larger adjustment than drift compensation adjustment, may reduce a magnitude of noise introduced into the load independent reference circuit 120 and reference signal by the adjustment or trimming process relative to conventional reference circuit implementations by utilizing passive components rather than active components. The use of passive components for initial accuracy adjustment may also reduce an amount of power consumed by the load independent reference circuit 120 relative to conventional reference circuit implementations by not requiring the components providing the initial accuracy adjustment to be powered by the power supply 110.

The filter stage 220 may include an operational transconductance amplifier $Gm_1$ and a filter capacitor $C_1$ which may have a magnitude selected to provide the high-pass and low-pass filtering discussed above. In some embodiments, the filter stage 220 may be realized using other forms of operational amplifiers and/or passive components arranged in such a manner as to provide a similar functionality to that of filter stage 220. Optionally, the filter stage 220 may also include scaling resistors (e.g., resistor $R_1$ and resistor $R_2$) in a feedback loop of the filter stage 220 to provide scaling for the reference signal. Generally, the operational transconductance amplifier $Gm_1$ may sense a pair of voltages (a first voltage at a first input port and a second voltage at a second input port) and based on a difference between the pair of voltages, generate an output current. The output current may be related to the pair of input voltages by a transconductance value of the operational transconductance amplifier $Gm_1$. In some embodiments, the operational transconductance amplifier $Gm_1$ receives the bandgap reference voltage generated by the bandgap reference stage 210 at the first input port (e.g., a positive input port) and an output of the buffer stage 230 (and thereby the reference signal provided by the load independent reference circuit 120, which may be scaled by one or more adjustment components) at the second input port (e.g., a negative input port). The operational transconductance amplifier $Gm_1$ may subtract the output of the buffer stage 230 from the bandgap reference voltage generated by the bandgap reference stage 210 and modify (e.g., scale or attenuate) the resulting voltage magnitude based on the transconductance value of the operational transconductance amplifier $Gm_1$ to determine an output current of the operational transconductance amplifier $Gm_1$. The capacitor $C_1$ may be coupled to the output of the operational transconductance amplifier $Gm_1$ to form the filter stage 220. The capacitor $C_1$ may filter an output signal of the operational transconductance amplifier $Gm_1$ through a process of charging and discharging the capacitor $C_1$ based on the output signal of the operational transconductance amplifier $Gm_1$. The filtered output signal of the operational transconductance amplifier $Gm_1$ may be transmitted to the buffer stage 230 for providing to the load circuit 130.

Each active component of the load independent reference circuit 120, as well as the resistors R1 and R2 (by virtue of their coupling directly to the output of the buffer stage 230) may contribute to an overall magnitude of noise present in the reference signal. For each component of the load independent reference circuit 120 that contributes to the overall magnitude of noise present in the reference signal, a determination of a magnitude of noise contributed by each component may be made according to the below equations.

$$\beta = 1 + \frac{R_2}{R_1} \tag{1}$$

$$\overline{E_{BG}} \approx \overline{e_{BG}} \times \frac{\beta}{1 + \frac{s\beta C_1}{Gm_1}} \tag{2}$$

$$\overline{E_{Gm1}} \approx \overline{e_{Gm1}} \times \frac{\beta}{1 + \frac{s\beta C_1}{Gm_1}} \tag{3}$$

$$\overline{E_{A2}} \approx \overline{e_{A2}} \times \frac{s}{s + \frac{Gm_1}{\beta C_1}} \times BW_{A2} \tag{4}$$

$$\overline{E_{R1}} \approx \overline{e_{R1}} \times \frac{(\beta - 1)}{1 + \frac{s\beta C_1}{Gm_1}} \tag{5}$$

$$\overline{E_{R2}} \approx \overline{e_{R2}} \times \frac{1}{1 + \frac{s\beta C_1}{Gm_1}} \tag{6}$$

In the above equations, β indicates a gain of the filter stage 220, $R_1$ is a magnitude of resistance of the resistor $R_1$, $R_2$ is a magnitude of resistance of the resistor $R_2$, $E_{BG}$ indicates a magnitude of noise present in the reference signal of the reference circuit 120 due to the bandgap reference stage 210, $e_{BG}$ indicates a magnitude of noise present at the output of the bandgap reference stage 210, $C_1$ is a magnitude of capacitance of the capacitor $C_1$, $Gm_1$ indicates a transconductance value of the operational transconductance amplifier $Gm_1$, $E_{Gm1}$ indicates a magnitude of noise present in the reference signal of the reference circuit 120 due to the operational transconductance amplifier $Gm_1$, $e_{Gm1}$ indicates a magnitude of noise present at the input of the operational transconductance amplifier $Gm_1$, $E_{A2}$ indicates a magnitude of noise present in the reference signal of the reference circuit 120 due to an amplifier of the buffer stage 230, as will be discussed below, $e_{A2}$ indicates a magnitude of noise present at an input of the amplifier of the buffer stage 230, $BW_{A2}$ is a bandwidth of the amplifier of the buffer stage 230 (and thereby the load independent reference circuit 120), $E_{R1}$ indicates a magnitude of noise present in the reference signal of the reference circuit 120 due to the resistor $R_1$, $e_{R1}$ indicates a magnitude of noise present at an output of the resistor $R_1$, $E_{R2}$ indicates a magnitude of noise present in the reference signal of the reference circuit 120 due to the resistor $R_2$, $e_{R2}$ indicates a magnitude of noise present at an output of the resistor $R_2$, and s is a mathematical construct used for performing calculations in a frequency domain.

As illustrated by the above equations, at least the filter stage 220 filters at least a portion of each source of noise within the load independent reference circuit 120. As such, the filter stage 220 may enable the load independent reference circuit 120 to reduce low-frequency and integrated noise of the reference signal relative to conventional reference circuit implementations.

The buffer stage 230 may include the amplifier $A_2$, and a plurality of transconductance output stages (e.g., a low-frequency transconductance output stage $Gm_{lf}$ and a high-frequency transconductance output stage $Gm_{hf}$). When low-frequency noise is filtered out of the load independent reference circuit 120 by the filter stage 220, for example, as discussed above, the components of the buffer stage 230 may be designed to have a minimal size, and correspondingly, reduced power consumption relative to larger sized components that balance decisions of reduced power consumption being accompanied by increased low-frequency noise production. Additionally, an output of the buffer stage 230 may be coupled to a load capacitor $C_2$ to enable operation of loads having a high current draw.

The buffer stage 230 may be configured as a buffering amplifier having a gain of one (unity gain) that buffers the bandgap reference stage 210 and the filter stage 220 from loading effects of the load circuit 130 to which the load independent reference circuit 120 may be coupled. The buffer stage 230 may be further configured to support a maximum possible bandwidth to support burst mode operation and enable compatibility of the load independent reference circuit 120 with a wide range of load circuits 130. The low-frequency transconductance output stage $Gm_{lf}$ and the high-frequency transconductance output stage $Gm_{hf}$ may be configured to sense a voltage magnitude on their input and output a magnitude of current corresponding to a relationship between the input voltage and a respective transconductance value for each of the low-frequency transconductance output stage $Gm_{lf}$ and the high-frequency transconductance output stage $Gm_{hf}$. The high-frequency transconductance output stage $Gm_{hf}$ may be configured to enable the load independent reference circuit 120 to support burst mode operation of the load circuit 130. That is, the high-frequency transconductance output stage $Gm_{hf}$ may be configured to enable the reference signal output by the load independent reference circuit 120 to respond with an optimal reference signal, or a reference signal within an acceptable range of variation of the optimal reference signal, when an instantaneous burst mode current draw, as discussed above, may be applied to the load independent reference circuit 120 by the load circuit 130. The high-frequency transconductance output stage $Gm_{hf}$ may be configured to support burst mode operation of the load circuit 130 such that the reference signal does not droop or decrease by more than one least significant bit from a first operation of the load circuit 130 (e.g., a first conversion by an ADC) to a last operation of the load circuit 130 (e.g., a last conversion by an ADC).

As discussed previously, in some embodiments it may also be desirable for the load independent reference circuit 120 to operate in a load independent manner such that a magnitude of current drawn by the load circuit 130 does not alter a bandwidth or magnitude of noise of the load independent reference circuit 120. Separating low-frequency and high-frequency operation into the low-frequency transconductance output stage $Gm_{lf}$ and the high-frequency transconductance output stage $Gm_{hf}$, respectively, may enable the load independent reference circuit 120 to establish a load independent bandwidth, and thereby, load independent integrated noise. This may be achieved in some embodiments by the load independent reference circuit 120 providing support for burst mode operation via the high-frequency transconductance output stage $Gm_{hf}$ and providing direct current load support via the low-frequency transconductance output stage $Gm_{lf}$. At direct current operation when a transconductance value $Gm_{LF}$ of the low-frequency transconductance output stage $Gm_{lf}$ may be much greater than a transconductance value $Gm_{HF}$ of the high-frequency transconductance output stage $Gm_{hf}$, and the low-frequency transconductance output stage $Gm_{lf}$ has a frequency domain pole located at $$1+\frac{s}{p_1},$$

the load independent nature of the load independent reference circuit 120 may be determined according to the below equations.

$$Gm_{LF}=\sqrt{K\times(I_{ddqLF}+I_{load})} \tag{7}$$

$$Gm_{HF}=\sqrt{K\times I_{ddqHF}} \tag{8}$$

$$BW=\frac{A_2\times Gm_{HF}}{2\pi C_2} \tag{9}$$

$$p_1 \ll BW\times\frac{Gm_{HF}}{Gm_{LF(max)}} \tag{10}$$

$$BW_{no\ load}=BW_{max\ DC\ load} \tag{11}$$

In the above equations, $Gm_{LF}$ is the transconductance value of the low-frequency transconductance output stage $Gm_{lf}$, $Gm_{HF}$ is the transconductance value of the high-frequency transconductance output stage $Gm_{hf}$, K is a constant used in determining transconductance, $I_{ddqLF}$ is a magnitude of current used to bias the low-frequency transconductance output stage $Gm_{lf}$, $I_{ddqHF}$ is a magnitude of current used to bias the high-frequency transconductance output stage $Gm_{hf}$, $I_{load}$ is a magnitude of current drawn by a load coupled to the load independent reference circuit 120 (e.g., the load circuit 130), BW is a bandwidth of the load independent reference circuit 120, $A_2$ is a gain of the amplifier $A_2$, $C_2$ is a magnitude of capacitance of the load capacitor $C_2$, and $p_1$, is the pole of the low-frequency transconductance output stage $Gm_{lf}$.

As illustrated by the above equations, the transconductance value $Gm_{LF}$ of the low-frequency transconductance output stage $Gm_{lf}$ does not affect the bandwidth of the load independent reference circuit 120, and the high-frequency transconductance output stage $Gm_{hf}$ may not be a function of the load current $I_{load}$. Thus, by separating the low-frequency transconductance output stage $Gm_{lf}$ and the high-frequency transconductance output stage $Gm_{hf}$, the bandwidth of the load independent reference circuit 120 may be independent of a load coupled to the load independent reference circuit 120. Therefore, a load coupled to the load independent reference circuit 120 does not affect a magnitude of integrated noise of the load independent reference circuit 120 by way of altering the bandwidth of the load independent reference circuit 120.

As illustrated through the above description, various embodiments of the load independent reference circuit 120 enable providing of a burst mode or non-burst mode reference signal to a load at lower power, higher bandwidth, and having less noise relative to conventional reference circuit implementations.

The above discussion is meant to be illustrative of the principles and various implementations of the present disclosure. Numerous variations and modifications will become apparent to those skilled in the art once the above disclosure is fully appreciated. It is intended that the following claims be interpreted to embrace all such variations and modifications.

What is claimed is:

1. A reference circuit, comprising:

a reference stage configured to generate a reference voltage or current;

a filter stage coupled to the reference stage and configured to:

receive the reference voltage or current;

filter first noise from the reference voltage or current;

receive a buffer output voltage or current; and filter second noise from the buffer output voltage or current; and a buffer stage coupled to the filter stage and a load circuit and configured to:

isolate the reference stage and the filter stage from a loading effect of the load circuit; and generate a reference signal based on the reference voltage or current to drive the load circuit.

2. The reference circuit of claim 1, wherein at least one active or passive electrical component trims the reference voltage prior to receipt of the bandgap reference voltage by the filter stage.

3. The reference circuit of claim 1, wherein the filter stage comprises an operational transconductance amplifier coupled to a filter capacitor.

4. The reference circuit of claim 3, wherein the filter stage further comprises a plurality of resistors coupled to the operational transconductance amplifier via a feedback loop.

5. The reference circuit of claim 1, wherein the buffer stage comprises an amplifier, a low-frequency transconductance output stage, and a high-frequency transconductance output stage.

6. The reference circuit of claim 5, wherein a load capacitor is coupled to an output of the low-frequency transconductance output stage and the high-frequency transconductance output stage.

7. The reference circuit of claim 6, wherein a load independent bandwidth of the reference circuit is determined according to the amplifier, the high-frequency transconductance output stage, and the load capacitor.

8. The reference circuit of claim 1, wherein total noise of the reference circuit is load independent.

9. The reference circuit of claim 1, wherein the load circuit is an analog to digital converter (ADC).

10. A reference circuit, comprising:

a circuit configured to generate a temperature independent voltage or current;

an adjustment circuit configured to adjust the temperature independent voltage or current;

a filter configured to filter noise from the reference circuit; and a buffer coupled to the filter and a load and configured to drive the load to a voltage magnitude or current magnitude indicative of the temperature independent voltage or current.

11. The reference circuit of claim 10, wherein the noise is at least one of low-frequency flicker noise or integrated noise.

12. The reference circuit of claim 10, wherein the noise is both low-frequency flicker noise and integrated noise.

13. The reference circuit of claim 10, wherein the noise is independent of the load.

14. The reference circuit of claim 10, wherein the filter is an operational transconductance amplifier coupled to a capacitor.

15. The reference circuit of claim 10, wherein the buffer circuit drives a burst mode operation of the load.

16. The reference circuit of claim 10, wherein the buffer comprises a first output stage configured for low frequency operation and a second output stage configured for high frequency operation.

17. The reference circuit of claim 16, wherein the first output stage drives a direct current load, and wherein the second output stage determines a bandwidth of the reference circuit.

18. A reference circuit, comprising:

a bandgap reference configured to generate a bandgap reference voltage or current;

a resistor ladder coupled to the bandgap reference and configured to trim the bandgap reference voltage or current;

an operational transconductance amplifier coupled to the resistor ladder and configured to filter out at least a portion of electrical noise in the reference circuit; and a buffer coupled to the operational transconductance amplifier and configured to isolate and drive a load coupled to the reference circuit based on a filtered signal of the reference circuit.

19. The reference circuit of claim 18, wherein the filtered signal is a reference signal, and wherein the buffer drives the load using the reference signal that droops less than one least significant bit from a first operation of the load to a last operation of the load.

20. The reference circuit of claim 19, wherein the buffer drives a burst mode operation of the load.

21. The reference circuit of claim 19, wherein the electrical noise and a bandwidth of the reference circuit are independent of the load.

22. The reference circuit of claim 19, wherein the buffer comprises a first output stage configured for low frequency operation and a second output stage configured for high frequency operation.

23. The reference circuit of claim 22, wherein the first output stage drives a direct current load, and wherein the second output stage determines a bandwidth of the reference circuit.

* * * * *